US006273357B1

(12) United States Patent
Figge et al.

(10) Patent No.: US 6,273,357 B1
(45) Date of Patent: Aug. 14, 2001

(54) CAROUSEL COILER WITH TWO COILER ARBORS

(75) Inventors: Dieter Figge, Essen; Karl-Heinz Wessel, Dinslaken, both of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/581,883

(22) PCT Filed: Nov. 30, 1998

(86) PCT No.: PCT/DE98/03624

§ 371 Date: Jul. 7, 2000

§ 102(e) Date: Jul. 7, 2000

(87) PCT Pub. No.: WO99/30851

PCT Pub. Date: Jun. 24, 1999

(30) Foreign Application Priority Data

Dec. 17, 1997 (DE) ..... 197 58 106

(51) Int. Cl.[7] ..... B65H 19/22
(52) U.S. Cl. ..... 242/533.4; 242/559.2
(58) Field of Search ..... 242/533.4, 533.5, 242/533.6, 559.2

(56) References Cited

U.S. PATENT DOCUMENTS 4,728,051 * 3/1988 Rothenpieler et al. ..... 242/533.6
5,660,351 * 8/1997 Osanai ..... 242/533.4
5,695,150 * 12/1997 Chevet et al. ..... 242/533.6
5,904,313 * 5/1999 Perret et al. ..... 242/533.6
5,921,498 * 7/1999 Wessel et al. ..... 242/533.6
5,934,602 * 8/1999 Jendroska et al. ..... 242/533.6
6,065,713 * 5/2000 Perenon ..... 242/533.4

* cited by examiner

*Primary Examiner*—William A. Rivera
(74) *Attorney, Agent, or Firm*—Cohen, Pontani, Lieberman & Pavane

(57) ABSTRACT

An apparatus for the winding of striplike material, in particular steel strip, in each case on one of two spreadable winding mandrels which are arranged, overhung, horizontally and parallel to one another and which, driven in rotation independently of one another, are mounted, in a carrying structure rotatable about a common horizontal central axis, on a vertical carrying wall in the form of a circular disk. The carrying wall in the form of a circular disk is arranged coaxially at the end of a central carrying shaft mounted, at its end opposite the carrying wall, in a rotary bearing. The gears for the winding mandrels are arranged, on the side of the carrying wall which faces away from the winding mandrels, in selfsupporting cases with cover division, which are connected to the carrying wall and with the latter form the carrying structure and which are themselves connected supportingly to at least one carrier which is fastened, overhung, to the carrying wall, so as to be parallel to the carrying shaft, and which, between the gear case and the rotary bearing, carries the drive motors for the winding mandrels, said drive motors being arranged on brackets.

13 Claims, 3 Drawing Sheets

(II II)

(IV IV)

(III III)

CAROUSEL COILER WITH TWO COILER ARBORS

BACKGROUND OF THE INVENTION

The invention relates to a device for the winding of striplike material, in particular steel strip, in each case on one of two spreadable winding mandrels which are arranged, overhung, horizontally and parallel to one another and which, driven in rotation independently of one another, are mounted, in a carrying structure rotatable about a common horizontal central axis, on a vertical carrying wall in the form of a circular disk, the circumferential region of which forms an annular running rail which coaxially surrounds the central axis of the carrying structure and which supports the carrying wall rollably on running wheels, the rotary drives for the winding mandrels, together with the carrying structure, being fastened rotatably to the latter.

Winding devices of the above described type are also known as reversible winders or rotary coilers and are used in continuous-strip plants in the hot and cold sectors. They are capable of carrying out a coil change at extremely short time intervals and of thereby replacing two conventional separate winders. The winding devices equipped with two winding mandrels make it possible, as early as toward the end of the winding operation which is not yet concluded, to pivot the winding mandrel, together with the coil, into the removal position as a result of the rotation of the carrying structure about its central axis, while the other winding mandrel simultaneously pivots into the standby position for the beginning of the next winding operation. After the strip has been severed by means of high-speed parting shears, the start of the subsequent strip can be gripped and wound without delay on the standing-by winding mandrel.

DE 19543046.A1 generally describes a rotary winder wherein, the spreadable winding mandrels, themselves capable of being driven in rotation independently of one another, are mounted in a drumlike carrying structure capable of being driven in rotation about a common horizontal central axis, the rotary drives for the winding mandrels being rotated together with the carrying structure. As a result, the winding mandrels can be driven directly, that is to say without a variable-ratio gear being interposed; cost-intensive gears with a multiplicity of spur wheel transmission stages are dispensed with.

The drumlike carrying structure has two vertical and mutually parallel carrying walls in the form of a circular disk, which are spaced from one another, and longitudinal members which connect these and on which the winding mandrels, which pass through one carrying wall, and spreading drives are mounted. The rotary drives are flanged to the outside of the other carrying wall and are connected to the winding mandrel through the carrying wall via cardan shafts. The carrying structure thus receives in it the winding mandrels and, in particular, their spreading drives and, at the same time, also carries the rotary drives flanged to one carrying wall, so that these, together with the carrying wall of the carrying structure, can be rotated about the central axis. The connection between the rotary drives and the winding mandrels is made via cardan shafts which make it possible to distribute the winding mandrels, offset, on the circumference of the carrying wall.

Even though the known winder was a marked improvement, as compared with the prior art, the arrangement of the spur wheel gears, the mounting of the drumlike carrying structure with two carrying walls and the connection between gear and electric motor are nevertheless too complicated and required too much space. Due to the great weight of the carrying structure, this winding device was also too costly, measured against conventional winders.

SUMMARY OF THE INVENTION

An object of the present invention is to provide a rotary winder with multiple winding mandrels for the winding of striplike material which does not require the use of the complicated and heavy framework for the drumlike carrying structure, while, due to a marked saving of weight, is a more cost-effective solution without impairing the functioning capacity.

The invention achieves its object in that the carrying wall in the form of a circular disk is arranged coaxially at the end of a central carrying shaft mounted, at its end opposite the carrying wall, in a rotary bearing. In the invention the gears for the winding mandrels are arranged, on the side of the carrying wall facing away from the winding mandrels, in self-supporting cases with cover division, which are connected to the carrying wall and with the latter form the carrying structure and which are themselves connected supportingly to at least one carrier which is fastened, overhung, to the carrying wall, so as to be parallel to the carrying shaft, and which, between the gear case and the rotary bearing, carries the drive motors for the winding mandrels, the drive motors being arranged on brackets.

Instead of the spur wheel gears being screwed into the drumlike carrying structure, the gears for driving the winding mandrel are arranged in self-supporting cases which, together with the carrying wall, form the carrying structure. Instead of two carrying walls in the form of a circular disk being provided, as hitherto, according to the invention only one carrying wall is used, which is fastened to the end of a central carrying shaft mounted at the other end in a rotary bearing. The drive motors for the winding mandrels are fastened to at least one carrier which is fastened, parallel to the carrying shaft, to the rear side of the carrying wall and to the case for the gear.

According to the invention, a semiopen mounting with preferably three running rollers is used for the carrying wall in the form of a circular disk, at least one running wheel being arranged below the carrying wall in the form of a circular disk, and at least one running wheel arranged on each of the two sides of the carrying wall being provided for the lateral forces acting transversely to the carrying wall. The weight of the entire device therefore rests on the running roller arranged below the carrying wall and on the rotary bearing provided at the other end of the carrying shaft. The lateral running rollers absorb the strip traction forces and serve for the lateral guidance of the carrying wall.

According to a particular feature of the invention, there is provision for the carrier for the drive motors to be designed as a tube, preferably, according to another feature of the invention, a respective tube being assigned to each case and drive motor. The tubes screwed to the gear case side walls leave room, in the middle, for the carrying shaft, which, according to a further feature of the invention, is received in the rotary bearing designed as a self-aligning roller bearing.

When two tubes are used as a carrier for the drive motors, these can be oriented by means of their brackets in such a way that, according to a further feature of the invention, the input shafts of the gears are in alignment with the output shafts of the motors and are connected to one another via short cardan shafts. These short cardan shafts are not only less costly than long cardan shafts, due to the fact that the input and output shafts are in alignment with one another, but the transmitted torques need not be deflected, so that more favorable drive conditions also prevail.

In a further embodiment of the invention, there is provision for the winding mandrels to be designed as exchangeable plug-in mandrels which are held in the gear output shafts designed as a hollow shaft. The winding mandrels, may, as required, be quickly drawn off axially and changed. The gear does not need to be opened for this purpose, and the necessary exchange work can therefore be carried out in a very short time and without any high outlay.

Finally, according to a further feature of the invention, it is proposed that slow rotary transmitters for hydraulic oil, grease and water as supply media and for the control power be provided at that end of the carrying shaft which is located on the rotary-bearing side.

The invention has provided a simple and more cost-effective device for the winding of striplike material, which is distinguished by particularly simple maintenance, along with good access to the parts of the device.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENT

Figure 1:
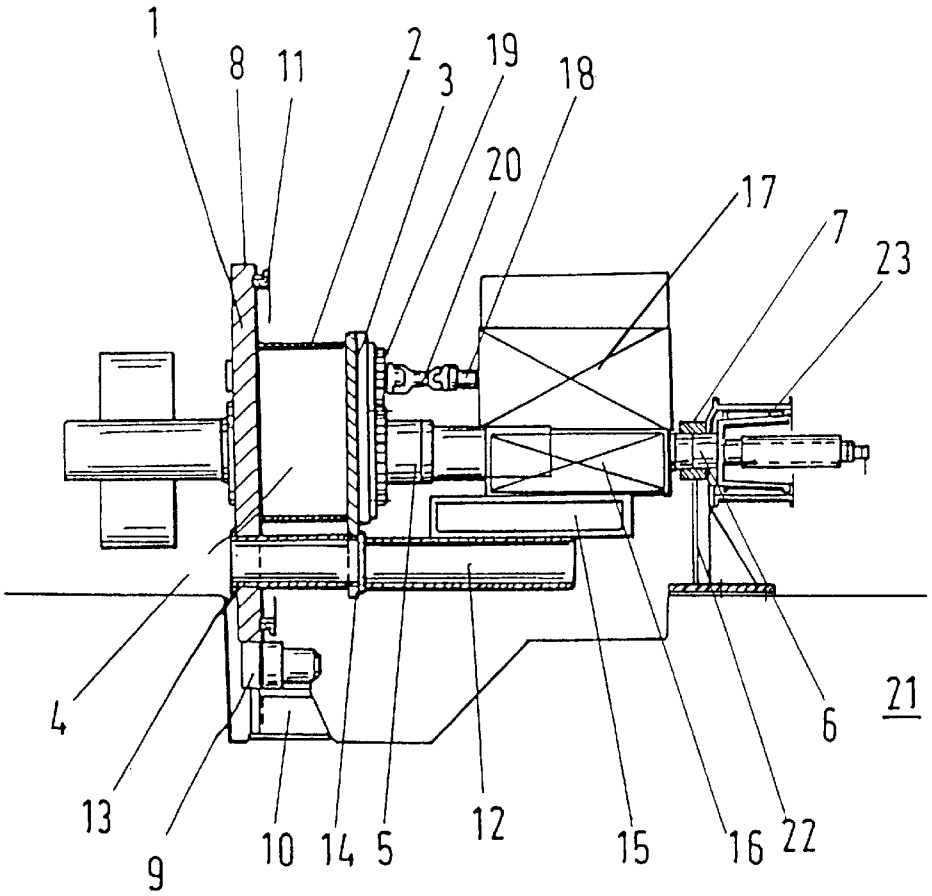
FIG. 1 shows a sectional side view of an apparatus of the invention for the winding of striplike material.

Referring to FIG. 1, a carrying wall 1 in the form of a circular disk, to which the self-supporting gear case 2, together with the releasable cover 3, is welded is shown. Attached to the carrying wall 1 coaxially to the central axis 4 is the carrying shaft 5, which extends toward the side (on the right in the drawing) facing away from the carrying wall 1 and is mounted there at 6 in the self-aligning roller bearing 7. The carrying wall 1 itself is rotatably supported with its circumferential side 8 on a lower running roller which is itself mounted on a bracket 10. The rotary drive of the carrying wall 1 in the form of a circular disk engages into the circumferential toothed pinion 11 in a way not illustrated.

As is apparent from FIG. 1 of the drawing, two carrying tubes 12 projecting in the direction of the self-aligning roller bearing 7 are fastened at 13, parallel to and below the carrying shaft 5, in the carrying wall 1, on the one hand, and to the case wall 14 of the gear case 2, on the other hand. Saddle-mounted on each projecting end of the carrying tubes 12, in each case on brackets 15 and 16, is one of the two drive motors 17, the output shafts 18 of which are in alignment with the input shafts 19 of the gears (not illustrated) arranged in the gear case 2. The connection of the motor output shaft 18 to the gear input shaft 19 is made via the short cardan shaft 20. The self-aligning roller bearing 7 is mounted in a raised position on the foundation 21 at 22. A slow rotary transmission 23, seated on the carrying shaft, for hydraulic oil, water and grease and also for the current for power transmission and for the signal data of noncontact optoelectronic transmitters are provided next to the self-aligning roller bearing.

Figure 2:
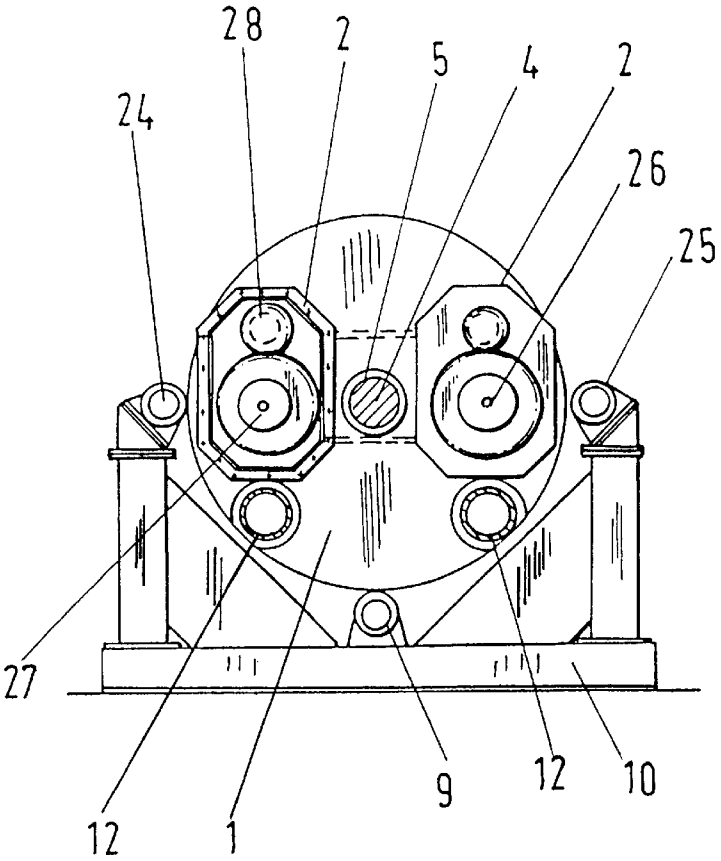
FIG. 2 shows a cross section through the device according to the invention according to FIG. 1 along the sectional line II—II.

As shown in FIG. 2, the carrying wall 1 rests on only a single running roller 9 vertically below the axis of rotation 4. Laterally supported running rollers 24 and 25 are arranged in the carrying structure 10 in such a way that they absorb the strip traction forces of the strip wound onto the winding mandrel 26 or 27 and at the same time perform the lateral guidance of the supporting wall 1. The gear cases are designated by 2, the gear case located on the left in the drawing being opened as a result of the removal of the cover 3. This brings into view the spur wheel toothing 28 which conducts the drive torque from the drive motor 17 to the mandrel. At the center of the carrying wall 1 can be seen the carrying tube 5 which passes through an intermediate wall between the gear cases 2. Below the gear cases 2 can be seen the tubes 12, which are connected to the gear cases 2 laterally and to the carrying wall 1 on the end face.

Figure 3:
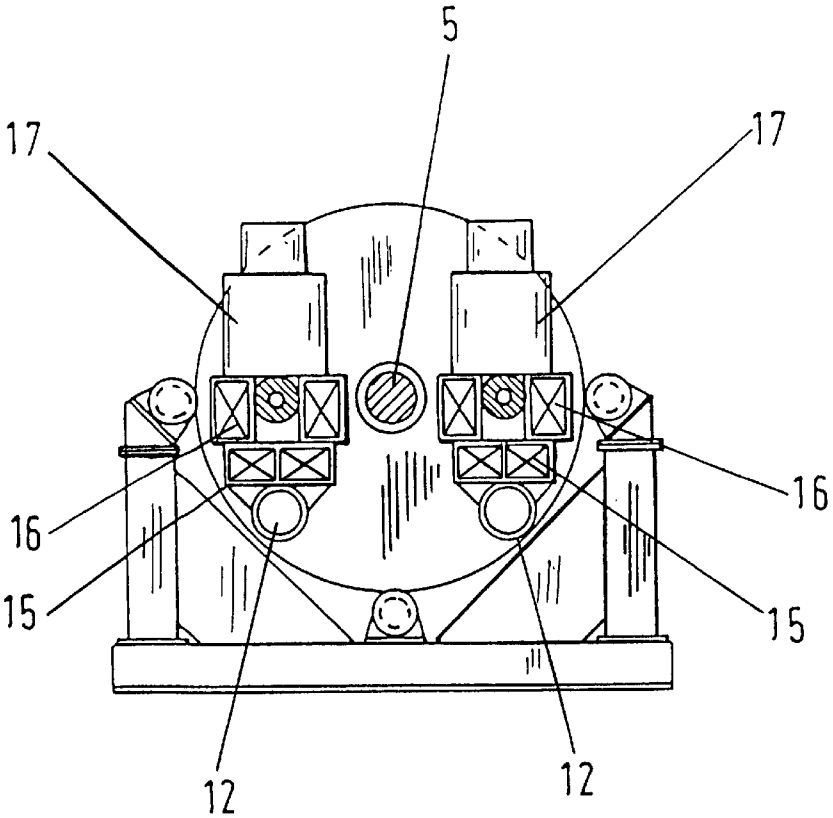
FIG. 3 shows a section through the device according to FIG. 1 along the sectional line III—III.

FIG. 3 of the drawing shows a section along the sectional line III—III, that is to say in the region of the drive motors. As can be seen, the drive motors 17, carried by brackets 15 and 16, are arranged in such a way that the rear end of the winding mandrel shaft is accommodated between the brackets 16. There is sufficient space for the carrying shaft 5 between the two drive motors 17, as may also be seen from the figure of the drawing.

Figure 4:
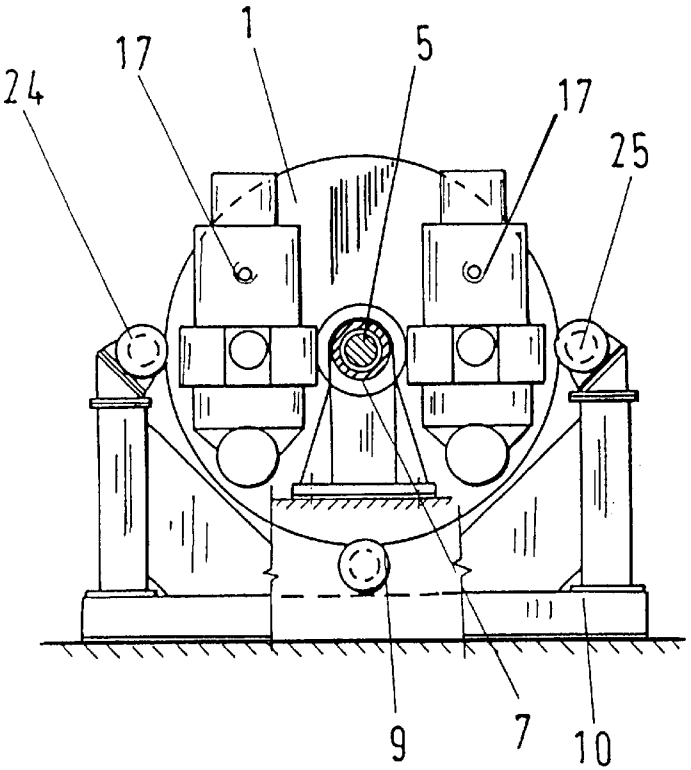
FIG. 4 shows a section through the device according to FIG. 1 along the sectional line IV—IV

FIG. 4 shows the mounting of the carrying shaft 5 at the rear end in another section taken in the region of the rotary bearing 7. Like parts are otherwise designated identically.

Figure 5:
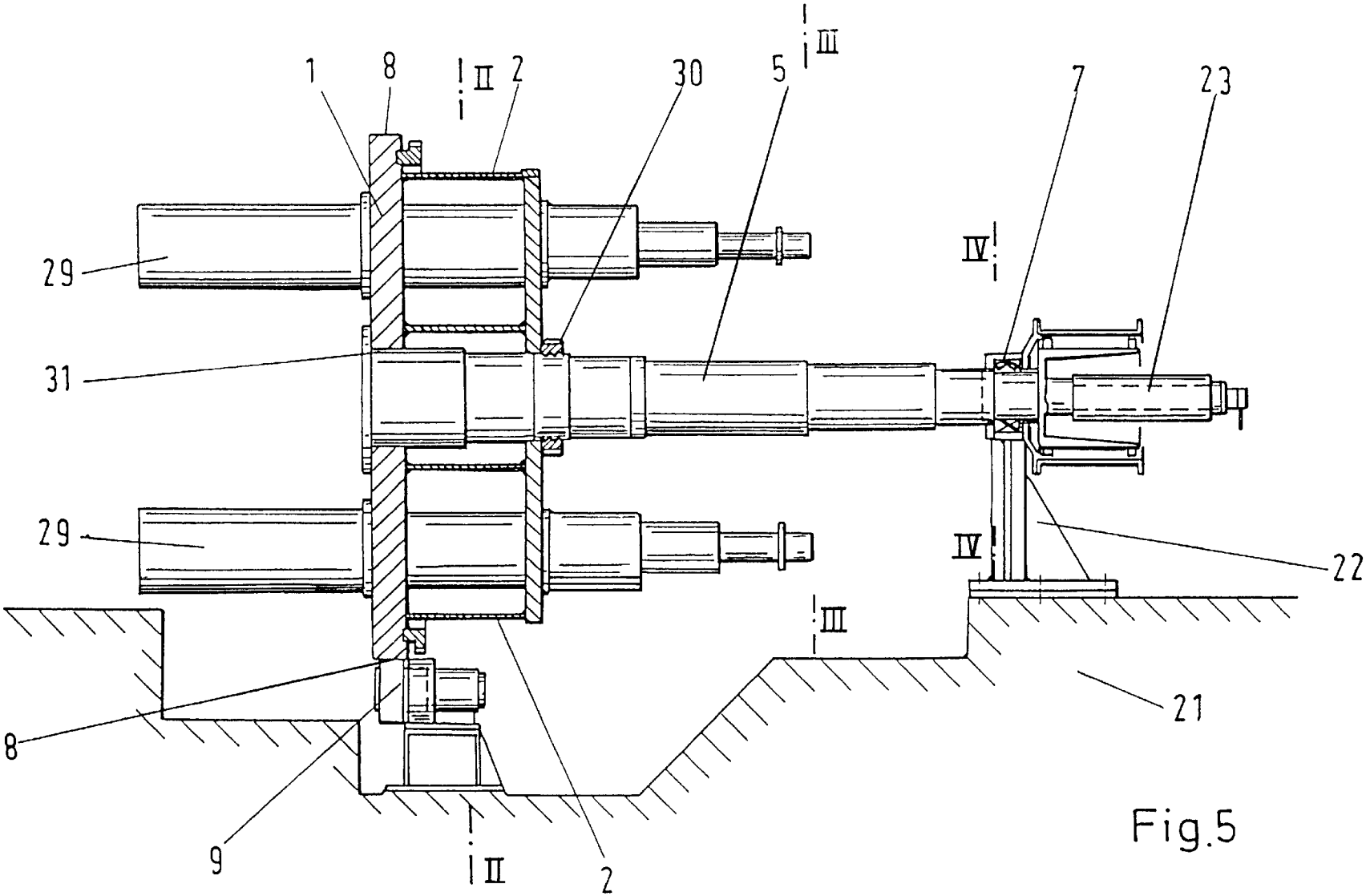
FIG. 5 shows an apparatus of to the invention according to FIG. 1 diagrammatically in a position of the carrying wall rotated through 90°.

FIG. 5 once again illustrates the device according to the invention in a sectional side view in which the carrying wall 1 has been rotated through 90°, so that the winding mandrels 29 are located one above the other. Here too, the carrying shaft 5 is illustrated at the center between the mandrels prolonged rearward through the gear cases 2. Carrying shaft 5, on the one hand, is fixed to the gear case 2 by means of a grooved nut 30 and, on the other hand, is held centrally in a bore 31 of the carrying wall 1. The rear end of the carrying shaft 5 is received in the self-aligning roller bearing 7, which is supported at 22 on the foundation 21. Here too, the conventional rotary transmitter 23 is indicated merely diagrammatically. The winding mandrels 29 are designed as plug-in mandrels and can easily be drawn axially out of the gears without the gear cases 2 having to be opened for this purpose. In this drawing, too, like parts are designated identically. The spreading drives of the winding mandrels 29 are themselves not illustrated.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

What is claimed is:

1. An apparatus for winding a striplike material comprising:

a carrying structure rotatable about a common horizontal central axis;

two spreadable mandrels arranged overhung, horizontally and parallel to each other and rotatably driven independent of one another; said mandrels being arranged in said carrying structure;

a vertical carrying wall in the form of a circular disk and having a circumferential region and a side facing away from said mandrels, said carrying wall being supported by said carrying structure;

a central carrying shaft extending coaxially from said carrying wall and mounted in a rotary bearing at said shaft's opposite end;

gears for the winding mandrels arranged on the side of the carrying wall facing away from the winding mandrels, said gears being housed in self supporting housings;

drive motors for driving the winding mandrels; and wherein the self supporting housings are connected supportingly to at least one carrier comprising a tube, said least one carrier being fastened, overhung, to the carrying wall, and parallel to the carrying shaft, and which between the housings and the rotary bearing, carries the drive motors for the winding mandrels.

2. The apparatus of claim 1, wherein the circumferential region of said carrying wall forms an annular running rail which coaxially surrounds the central axis of the carrying structure.

3. The apparatus of claim 2, wherein the vertical carrying wall is supported on at least one wheel.

4. The apparatus of claim 3, wherein the least one wheel is arranged below the carrying wall in the form of a circular disk.

5. The apparatus of claim 4 further comprising at least one wheel arranged on each of the two sides of the carrying wall for lateral forces acting transversely to the carrying wall.

6. The apparatus of claim 1, wherein the carrier comprises two tubes and each tube is respectively assigned to each housing and drive motor.

7. The apparatus of claim 1, wherein the rotary bearing is a self-aligning roller bearing.

8. The apparatus of claim 1, wherein each gear has an input shaft and each motor has an output shaft and each of said input shafts is respectively aligned with each of said output shafts.

9. The apparatus of claim 8 wherein the aligned input and output shafts are connected by cardan shafts.

10. The apparatus of claim 1, wherein each gear has an output shaft and the winding mandrels are exchangeable plug-in mandrels which are retained in the gear output shafts.

11. The apparatus of claim 10 wherein the gear output shafts are hollow shafts.

12. The apparatus of claim 1, further comprising slow rotary transmitters for hydraulic oil, grease and water as supply media and for current, power and control data, said transmitters being provided at that end of the carrying shaft which is located on the rotary-bearing side.

13. The apparatus of claim 1 wherein the drive motors are arranged on brackets.

* * * * *